US005884861A

United States Patent [19]

Hosomi et al.

[11] Patent Number: 5,884,861

[45] Date of Patent: Mar. 23, 1999

[54] PAPER TERMINATION DETECTING APPARATUS

[75] Inventors: Hiroaki Hosomi; Toru Takami; Akio Nomura; Satoshi Nakajima; Yoshiharu Matsumoto, all of Nagano, Japan

[73] Assignee: Seiko Epson Corporation, Tokyo, Japan

[21] Appl. No.: 811,730

[22] Filed: Mar. 6, 1997

[30] Foreign Application Priority Data

Mar. 6, 1996 [JP] Japan ..... 8-049011

[51] Int. Cl.[6] ..... B65H 16/02; B65H 26/08

[52] U.S. Cl. ..... 242/563; 242/595

[58] Field of Search ..... 242/563, 563.2, 242/591, 595; 83/649, 949

[56] References Cited

U.S. PATENT DOCUMENTS

| | | | |
|---|---|---|---|
| 4,204,180 | 5/1980 | Usui et al. | 242/563.2 |
| 4,456,193 | 6/1984 | Westover | 242/563.2 |
| 5,000,393 | 3/1991 | Madsen | 242/563 |
| 5,396,313 | 3/1995 | Zoltner et al. | 242/563 |
| 5,566,906 | 10/1996 | Kamada et al. | 242/563 |

FOREIGN PATENT DOCUMENTS

| | | |
|---|---|---|
| 0649808 | 4/1995 | European Pat. Off. . |
| 61-3872 | 5/1986 | Japan . |
| 1-14597 | 4/1989 | Japan . |

OTHER PUBLICATIONS

Patent Abstract of Published Japanese Patent Application 58116184, published Jul. 11, 1983.

Patent Abstract of Published Japanese Patent Application 59143671, published Aug. 17, 1984.

IBM Technical Disclosure Bulletin, vol. 37, No. 5, May 1994, pp. 195–196.

IBM Technical Disclosure Bulletin, vol. 38, No. 9, Sept. 1995, pp. 129–130.

*Primary Examiner*—John M. Jillions
*Attorney, Agent, or Firm*—Sughrue, Mion, Zinn, Macpeak & Seas, PLLC

[57] ABSTRACT

A paper termination detecting apparatus for detecting an amount of a paper roll that is below a predetermined amount of paper, having: a detecting lever including a detecting piece being movable within a space of a core part of the paper roll, and a protruding piece spaced a predetermined distance apart from the detecting piece, the protruding piece being allowed to come in contact with a side of the paper roll; and a detecting switch for converting a motion of the detecting lever into an electrical signal when the detecting piece moves into the space of the core part of the paper roll.

14 Claims, 4 Drawing Sheets

PAPER TERMINATION DETECTING APPARATUS

BACKGROUND OF THE INVENTION

The present invention relates to a paper termination detecting apparatus for detecting a near end of a paper roll to be supplied to a printer, that is, for detecting when a paper roll is nearly terminated.

This type of paper termination detecting apparatus is disclosed in, for example, Japanese Utility Model Laid-Open Publication Nos. Sho. 61-3872 and Hei. 1-14597. In the disclosed apparatus, a detecting piece constantly urges the side of a roll of print paper. When an amount of the paper roll remaining to be used for printing is reduced to below a predetermined amount of paper, the detecting piece is put in a space of the core part of the paper roll. According to that operation, a detecting switch operates and recognizes the amount of the residual paper roll being small.

The conventional apparatus suffers from the following disadvantage. During the feeding of the paper roll to a printer, the paper roll is swung or moved toward the printer where paper feeding means is provided, and therefore, the paper roll is frequently located out of a desired detecting position where the detecting piece is placed. Specifically, when the paper roll is put out of the desired detecting position, a detecting lever having the detecting piece is out of the side of the paper roll. At this time, the detecting lever is turned as in case where the detecting piece is put into the core space of the paper roll. Then, the detecting switch operates. Though a sufficient amount of the paper still remains in the paper roll container, the paper termination detecting apparatus mistakenly operates to produce an incorrect amount of the residual print paper. The result allows the wasteful use of the paper.

SUMMARY OF THE INVENTION

Accordingly, an object of the present invention is to provide a reliable, paper termination detecting apparatus which can accurately detect the termination of a paper roll.

To achieve the above object, there is provided a paper termination detecting apparatus for detecting an amount of a paper roll that is below a predetermined amount of paper, comprising: a detecting lever including, a detecting piece movable within a space of a core part of the paper roll, and a protruding piece spaced at a predetermined distance apart from the detecting piece, the protruding piece being allowed to come in contact with a side of the paper roll; and a detecting switch for converting a motion of the detecting lever into an electrical signal when the detecting piece moves into the space of the core part of the paper roll.

In the paper termination detecting apparatus, when the protruding piece is in contact with the side of the paper roll, a top of the detecting piece of the detecting lever is substantially flush with a top of the protruding piece thereof on the side of the paper roll.

In the invention, the detecting lever includes a detecting piece and a protruding piece spaced a predetermined distance apart from the detecting piece. With the unique structure of the detecting lever, when the print paper is horizontally shifted and the detecting piece is located out of the side of the paper roll, the protruded piece comes in contact with the side of the paper roll. Therefore, the detecting switch is not driven to operate by the detecting lever.

Further, when the protruded piece is in contact with the side of the paper roll, the top of the detecting piece of the detecting lever is substantially flush with the top of the protruded piece thereof on the side of the paper roll. Therefore, when the detecting piece moves out of the side of the paper roll but the protruded piece comes in contact with the roll side, the detecting lever is turned by only a small amount.

BRIEF DESCRIPTION OF THE DRAWINGS

FIG. 5(*a*) is a sectional view showing an off-state of the paper termination detecting apparatus; and FIG. 5(*b*) is a sectional view showing an on-state of the paper termination detecting apparatus.

DETAILED DESCRIPTION OF THE PREFERRED EMBODIMENTS

The preferred embodiment of a paper termination detecting apparatus according to the present embodiment will be described with reference to FIGS. 1 through 5(*b*).

Figure 1:
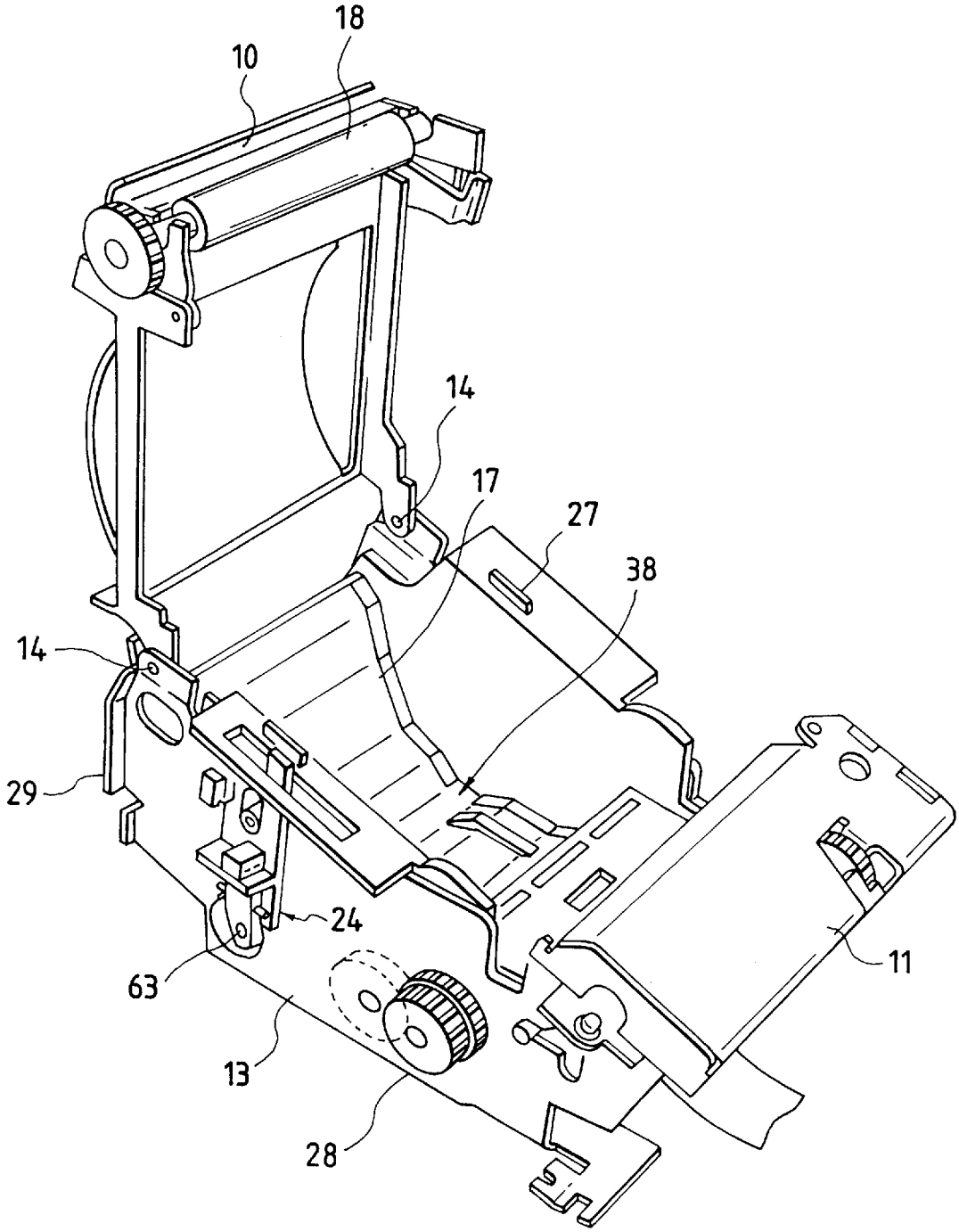
FIG. 1 is a perspective view showing a printer incorporating the present invention in a state that a cover frame is opened.
Figure 2:
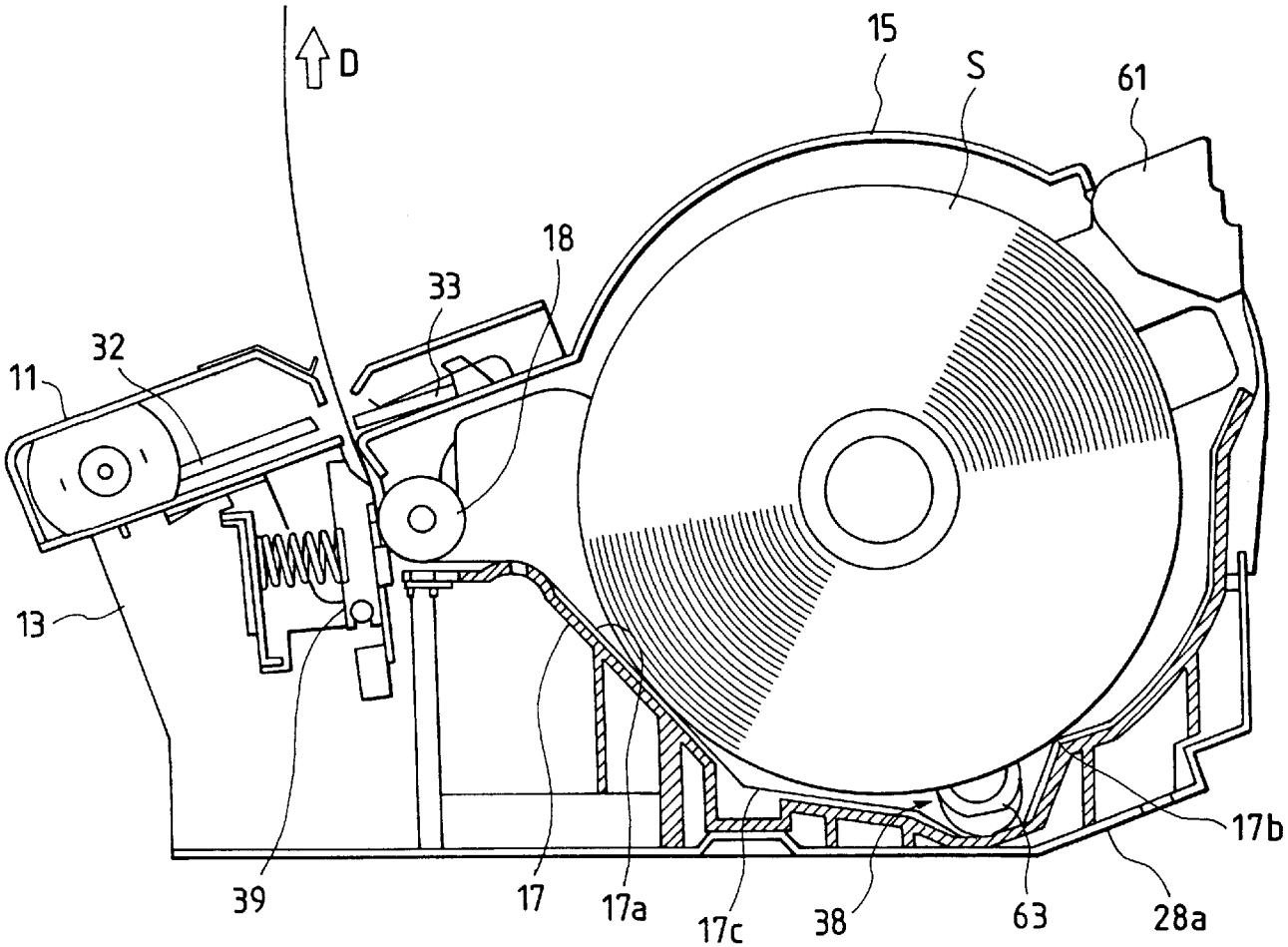
FIG. 2 is a longitudinal sectional view showing of the printer when the cover frame is closed.

FIG. 1 is a perspective view showing a printer incorporating the present invention thereinto in a state that a cover frame 10 is opened. The printer is a receipt printer of the type which is used for a POS system, for example. Characters, for example, are recorded or printed on a rolled recording or print paper S as one form of a recording medium, by a line thermal printing head 39 (FIG. 2). In a general construction of the printer, a printing unit and a paper cutting unit are disposed in the fore section, while a paper roll container for containing a paper roll S is disposed in the rear section.

The printer includes the cover frame 10 and an auto cutter unit 11 for containing a movable blade 32 and a drive means for driving the blade. The cover frame 10 is provided above the paper roll container in a state that it may be turned up for opening and turned down for closing.

The cover frame 10 may be turned about support shafts 14, which are provided at the upper ends of both sides of a main frame 13 made of metal, for example. The cover frame 10 is turned up for opening and turned down for closing. The cover frame 10 has an arcuate cover portion 15, a platen 18 and a fixed blade 33. The arcuate cover portion 15 is curved upward such that when the cover frame 10 is closed, it can receive the print paper S in a noncontact fashion.

A paper roll holder 17 made of resin is disposed within the main frame. It is seen when the cover frame 10 is opened. A paper termination detecting apparatus 24 is mounted on the left side of the main frame 13. The apparatus 24 is provided for detecting an amount of paper roll S remaining in the paper roll container.

FIG. 2 is a longitudinal sectional view showing of the printer when the cover frame is closed, a print paper S is set in the paper roll holder 17, and the paper is being fed to the printer. In the figure, the diameter of the print paper S is still large since the paper roll is in the initial stage of use. As the use of the paper S progresses the diameter of the paper roll becomes smaller thereby relocating the paper roll in guide 38. At this time, the paper termination detecting apparatus 24 detects the reduced diameter of the paper roll.

The print paper S rolled out of the paper roll is nipped between the platen 18 and the thermal print head 39, and when the platen 18 is turned, it is fed forward by a frictional force acting between the paper and the platen 18. After passing the thermal print head 39, the paper S passes between the movable blade 32 and the fixed blade 33 in the direction of an arrow D. When the paper S reaches a preset position, the movable blade 32 is driven to move to the fixed blade 33 to cut the paper S.

A basic construction of the printer 1 according to the embodiment of the present invention is as described above. Now, the paper termination detecting apparatus 24, which is essential to the present invention, will be described in detail with reference to FIGS. 3 through 5(*b*).

Figure 3:
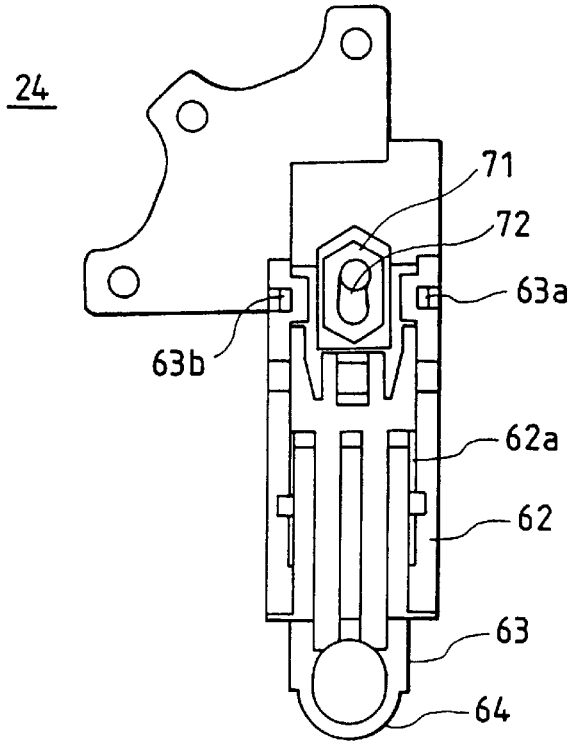
FIG. 3 is a front view showing the paper termination detecting apparatus according to the present invention.
Figure 4:
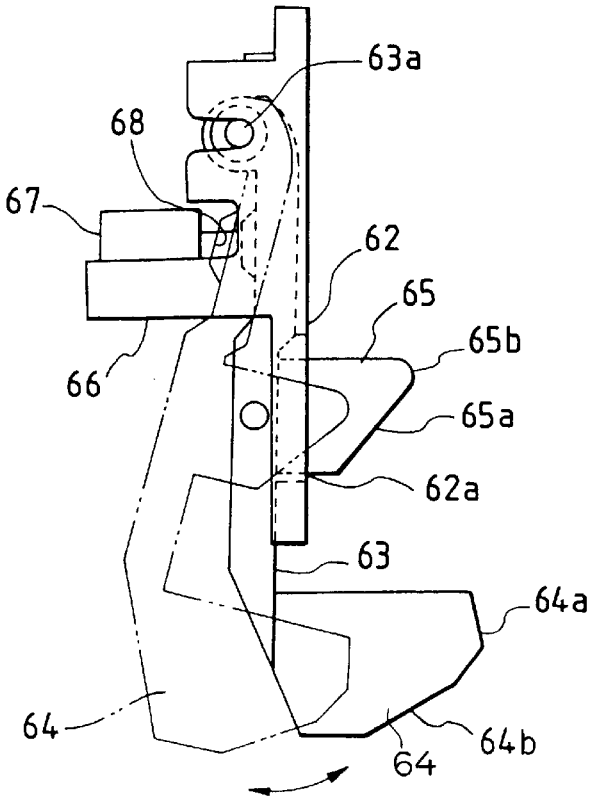
FIG. 4 is a side view showing the paper termination detecting apparatus according to the present invention.

FIGS. 3 and 4 are front and side views showing the paper termination detecting apparatus 24 according to the present invention.

The paper termination detecting apparatus 24 is generally constructed with a detecting frame 62 and a detecting lever 63, both being long members. The frames 62 and 63 are both made of resin, for example, acrylonitrile-butadiene-styrene copolymer (ABS) or polyacetal (POM). Support shafts 63*a* and 63*b* are provided at the base end of the detecting lever 63 while being disposed symmetrically with respect to the lever. The detecting lever 63 is mounted on the detecting frame 62 in such a fashion that the lever 63 may be turned about those support shafts 63*a* and 63*b*.

The detecting piece 64 to be in contact with the side of the print paper S is formed at the end of the detecting lever 63. The detecting piece 64 made of, for example, resin may be integral with the detecting lever 63. The detecting piece 64 extends at a right angle to the longitudinal direction of the detecting lever 63. The detecting piece 64 is narrowed toward its top so that it easily enters a space 76 of a core part 75 of the paper roll, as will be described in detail later.

As shown in FIG. 4, a protruding piece 65 to be described later is provided at the middle of the detecting lever 63. The protruded piece 65 is constructed with a plate-like member made of resin, for example. The protruded piece 65, similar to the detecting piece 64, extends at a right angle to the longitudinal direction of the detecting lever 63. The protruding piece 65 is slightly shorter than the detecting piece 64. The protruding piece 65 may be integral with the detecting lever 63.

The protruding piece 65 includes a face 65*a*, which is slanted down from the top of the protruded piece toward the detecting piece 64 side. Accordingly, when the protruding piece 65 is viewed from its side, the protruded piece 65 is narrowed toward its top.

As shown in FIG. 4, a window 62*a* is formed in the detecting frame 62. The window 62*a* allows the protruding piece 65 of the detecting lever 63 to escape therethrough. A limit switch 67 is provided on a support 66, which extends outward from the middle of the detecting frame 62. The detecting switch 67 is turned on and off with the turn of the detecting lever 63. In the present embodiment, a spring contained in the detecting switch 67 urges a switch pin 68 to press the detecting lever 63 against the detecting frame 62. The detecting switch 67 is connected to a main circuit board (not shown) which controls the printer by an FFC, for example.

Figure 5A:
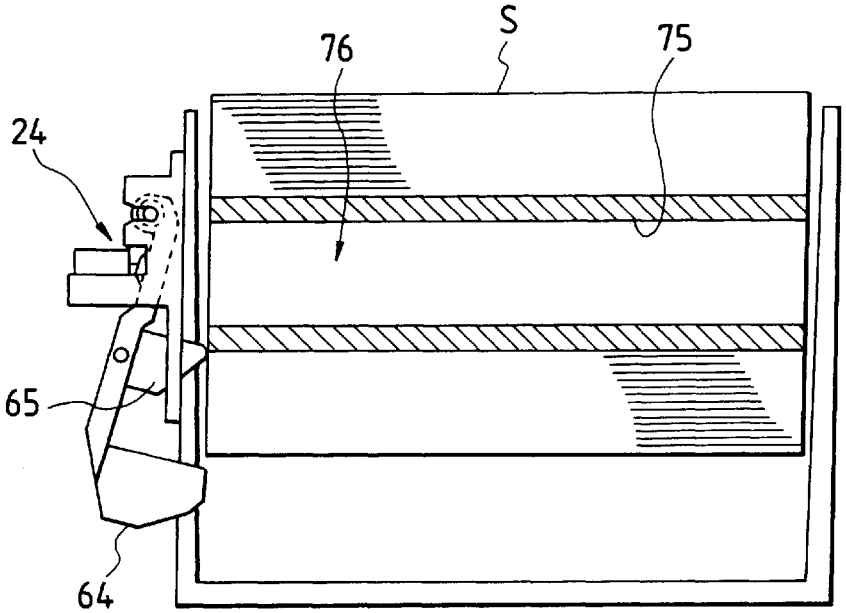
FIGS. 5(*a*) and 5(*b*) are views showing an operation of the paper termination detecting apparatus of the present embodiment.
Figure 5B:
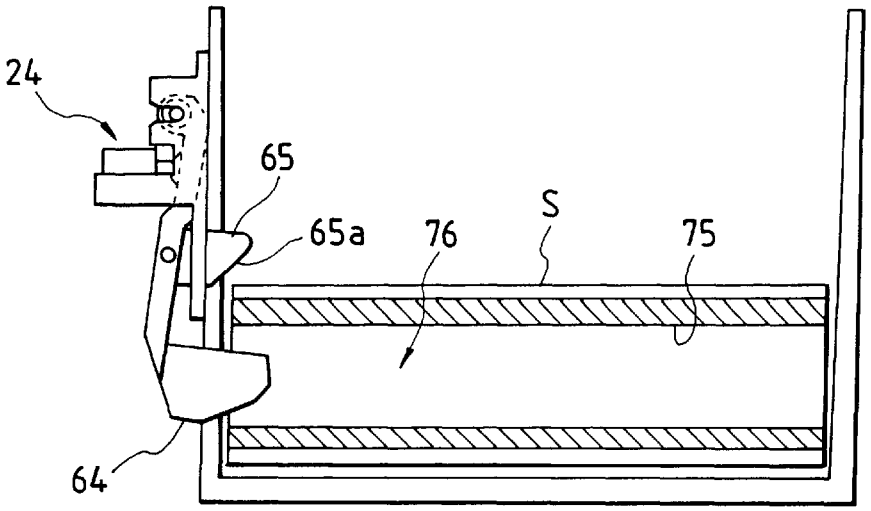

FIGS. 5(*a*) and 5(*b*) are diagrams showing an operation of the paper termination detecting apparatus 24 of the present embodiment. FIG. 5(*a*) is a sectional view showing an off-state of the paper termination detecting apparatus 24. FIG. 5(*b*) is a sectional view showing an on-state of the paper termination detecting apparatus 24.

When a large amount of print paper S remains to be used for printing, the detecting piece 64 or the protruded piece 65 of the detecting lever 63 is abutted against the side of a roll of the print paper S, as shown in FIG. 5(*a*). Accordingly, the detecting lever 63 is pushed back, so that the detecting switch 67 retains an off state.

In the line thermal printer as of the present embodiment, the transportation of the print paper S is not interruptive (in the serial printer, the print paper S is transported in an interruptive manner). Therefore, when the print paper S, which has been loosened by a pulling-up motion of the paper roll, is horizontally or widthwise shifted with respect to the paper roll, it is impossible to correct such a horizontal shift.

To cope with this, the paper roll holder 17 includes a gently slanted support surface 17*c*, which extends over an area of the paper feeding side of the guide 38, whereby the paper roll is allowed to horizontally shift in some degree by the pulling-up motion. With provision of the support surface 17*c*, when the platen 18 rotates to feed the print paper, the roll of the print paper S moves on the support surface 17*c*, and then hits a sharply slanted support surface 17*a* and returns to the guide 38. Thus, when the diameter of the paper roll is large, the print paper S is rolled out of the paper roll while repeating the forward and backward movements of the paper roll. When the diameter of the paper roll is small, the paper roll hardly moves out of the guide 38. In this case, if the print paper S is widthwise shifted, such a shift of the paper is readily corrected since the weight of the paper roll is small.

In the case of the paper roll having a medium diameter, when the paper roll moves to a position where the outer surface of the roll comes in contact with the sharply slanted support surface 17*a*, the detecting piece 64 of the detecting lever 63 is out of the side of the paper roll. In the present embodiment, as shown in FIG. 5(*a*), even if the paper S is widthwise shifted, either the detecting piece 64 or the protruded piece 65 of the detecting lever 63 is abutted against the side of the paper roll. Accordingly, the detecting lever 63 is not turned, and the detecting switch 67 is left off.

When the amount of print paper S remaining in the paper roll container is considerably small as shown in FIG. 5(*b*), the print paper S moves, and the detecting piece 64 of the detecting lever 63 enters the space 76 of the core part 75 of the paper roll. Therefore, the detecting switch 67 is turned off, and a signal representative of an off state is sent to the main circuit board. In this way, a paper termination state is detected.

As recalled, the protruding piece 65, which faces the print paper S, is included in the detecting lever 63. With provision of the protruding piece 65, if the print paper S is horizontally shifted, the paper termination detecting apparatus 24 retains an off state. Therefore, an exact detection of the termination of the print paper is ensured. Thus, the present invention is not limited to the case of continuously feeding the paper and the shape of the paper roll container, but may be applicable to other suitable cases.

In the serial printer such as a dot impact printer where the paper is intermittently fed for short time, when the paper is used and its roll diameter is small, the paper is instantly moved forward without being continuously pulled up. Also in this case, even if the detecting piece 64 is out of the side of the paper roll, the detecting lever 63 remains immovable so long as the protruded piece 65 is in contact with the side of the paper roll. Therefore, an exact detection of the paper termination is secured.

As described, the protruded piece 65 is slightly shorter than the detecting piece 64. When the detecting piece 64 is in contact with the side of the paper roll, the top 64*a* of the detecting piece 64 of the detecting lever 63 is substantially flush with the top 65*b* of the protruding piece 65 thereof on the side of the paper roll. Therefore, when the detecting piece 64 is out of the side of the paper roll but the protruding piece 65 is in contact with the roll side, the detecting lever 63 is turned very little, thereby improving a detection accuracy.

In the embodiment, as shown, the slanted faces 64*b* and 65*a* are respectively formed on the lower portion of each of the detecting piece 64 and the protruded piece 65. Provision of the slanted face 65*a* brings about the following advantage. In replacing the print paper S with a new one, the detecting piece 64 can be put out of the space 76 of the core part 75 by merely lifting the core part 75 of the paper roll having the detecting piece 64 of the detecting lever 63 being put in the space 76 of the core part. Therefore, it is easy to remove the core part 75 from the paper roll container. Further, a slanted face, which is formed on the underside of the protruding piece 65, brings about the following advantage. During the removal of the core part 75 of the paper roll from the paper roll container, if the core part hits the protruding piece 65, the protruding piece 65 is smoothly moved outside with the aid of the slanted face thereof. Thus, the provision of the slanted faces of the detecting piece 64 and the protruding piece 65 provide an easy handling.

In the paper termination detecting apparatus of the present embodiment, the related distance and dimensions thereof are selected so as to be suitable for detection of two types of core parts of the paper rolls used for ECRs, desk top calculators, or the like: the first type core part having 18 mm in outside diameter and 12 mm in inside diameter, and the second type core part having 22 mm in outside diameter and 12 mm inside diameter. As a matter of course, the present invention may be applied to other special types of core part.

While the limit switch is used for the paper termination detecting means in the embodiment mentioned above, any other suitable means, e.g., an optical switch, may be used instead. Incidentally, use of the limit switch is advantageous in that the paper termination detection is simple and reliable.

According to the present invention, even if the paper roll is moved out of the detecting position, either of the detecting piece or the protruding piece of the detecting lever stays on the side of the paper roll, and the detecting lever remains immovable and hence the detecting switch is not operated. Therefore, the paper termination detecting apparatus of the invention operates to detect an amount of paper roll remaining in the paper roll container only when it is reduced to a preset amount of paper. In this respect, a reliability of the apparatus is improved.

Furthermore, even if the detecting piece of the detecting lever is put out of the side of the paper roll, the detecting lever is turned very little so long as the protruding piece of the lever is in contact with the roll side. Therefore, the paper termination detecting apparatus can accurately detect the amount of residual paper roll.

What is claimed is:

1. A paper termination detecting apparatus for detecting a predetermined amount of a paper remaining on a paper roll, the paper roll having an outer cylindrical surface and a core part which defines a space therein, comprising:

a detecting lever having a first protruding portion and a second protruding portion spaced a predetermined distance apart from said first protruding portion, wherein said first protruding portion is movable within the space of the core Part of the paper roll, and wherein said second protruding portion is movable above the outer cylindrical surface of the paper roll; and a detecting switch for converting a motion of the detecting lever into an electrical signal when said first protruding portion moves into the space of the core part of the paper roll and said second protruding portion moves above the outer cylindrical surface of the paper roll.

2. The paper termination detecting apparatus according to claim 1, wherein said first protruding portion comprises a detecting piece movable within the space of the core part of the paper roll, and wherein said second protruding portion comprises a protruding piece spaced a predetermined distance apart from said detecting piece, said protruding piece positioned to come in contact with the side of the paper roll.

3. The paper termination detecting apparatus according to claim 1, wherein, when said second protruding portion is in contact with a side of the paper roll, a top of said first protruding portion of said detecting lever is substantially flush with a top of said second protruding portion on the side of the paper roll.

4. The paper termination detecting apparatus according to claim 1, wherein each of said first protruding portion and said second protruding portion has a slanted face.

5. The paper termination detecting apparatus according to claim 1, wherein said detecting switch includes a limit switch.

6. The paper termination detecting apparatus according to claim 5, wherein said detecting lever is rotatable and connects to said limit switch.

7. The paper termination detecting apparatus according to claim 1, wherein said second protruding portion is abutted against a side of the paper roll at least while said first protruding portion is outside the space of the core part of the paper roll and not abutted against the side of the paper roll, so as to prevent a motion of the detecting lever which will be converted into an electrical signal by the detecting switch.

8. A printing apparatus comprising:

a paper roll holder for accommodating a paper roll, the paper roll having an outer cylindrical surface and a core part which defines a space therein;

a detecting lever having a first protruding portion and a second protruding portion spaced a predetermined distance apart from said first protruding portion, wherein said first protruding portion is movable within the space of the core Part of the paper roll, and wherein said second protruding portion is movable above the outer cylindrical surface of the paper roll; and a detecting switch for converting a motion of the detecting lever into an electrical signal when said first portion moves into the space of the core part of the paper roll and said second protruding portion moves above the outer cylindrical surface of the paper roll.

9. The printing apparatus according to claim 8, wherein said first protruding portion comprises a detecting piece movable within the space of the core part of the paper roll, and wherein said second protruding portion comprises a protruding piece spaced a predetermined distance apart from said detecting piece, said protruding piece positioned to come in contact with the side of the paper roll.

10. The printing apparatus according to claim 8, wherein, when said second protruding portion is in contact with a side of the paper roll, a top of said first protruding portion of said detecting lever is substantially flush with a top of said second protruding portion on the side of the paper roll.

11. The printing apparatus according to claim 8, wherein each of said first protruding portion and said second protruding portion has a slanted face.

12. The printing apparatus according to claim 8, wherein said detecting switch includes a limit switch.

13. The printing apparatus according to claim 12, wherein said detecting lever is rotatable and connects to said limit switch.

14. A paper termination detecting apparatus for detecting a predetermined amount of a paper remaining on a paper roll, the paper roll having an outer cylindrical surface and a core part which defines a space therein, comprising:

a detecting lever having a first protruding portion and a second protruding portion spaced a predetermined distance apart from said first protruding portion, wherein said first protruding portion is movable within the space of the core part of the paper roll, and wherein said second protruding portion is movable above the outer cylindrical surface of the paper roll; and a detecting switch which detects when said first protruding portion moves into the space of the core part of the paper roll and said second protruding portion moves above the outer cylindrical surface of the paper roll.

* * * * *